US007935303B2

(12) United States Patent
Nakashima et al.

(10) Patent No.: US 7,935,303 B2
(45) Date of Patent: May 3, 2011

(54) LOW ALLOY STEEL

(75) Inventors: Takashi Nakashima, Hyogo (JP); Kaori Kawano, Hyogo (JP); Masaaki Igarashi, Hyogo (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/073,324

(22) Filed: Mar. 4, 2008

(65) Prior Publication Data

US 2008/0156400 A1 Jul. 3, 2008

Related U.S. Application Data

(63) Continuation of application No. PCT/JP2006/317532, filed on Sep. 5, 2006.

(30) Foreign Application Priority Data

Sep. 6, 2005 (JP) ..... 2005-258286

(51) Int. Cl.
*C22C 38/00* (2006.01)
*C22C 38/22* (2006.01)

(52) U.S. Cl. ..... 420/83; 420/105

(58) Field of Classification Search ..... 75/330, 75/392, 414, 433, 950, 951; 148/95, 559, 148/579, 622–624, 648, 649, 653, 654, 660–663, 148/400, 320, 328, 330–336, 405; 420/8, 420/83, 104, 123, 124, 129
See application file for complete search history.

(56) References Cited

U.S. PATENT DOCUMENTS

| | | | | |
|---|---|---|---|---|
| 2,823,992 | A * | 2/1958 | Knapp et al. | 420/83 |
| 5,997,806 | A | 12/1999 | Fujita et al. | |

FOREIGN PATENT DOCUMENTS

| | | | |
|---|---|---|---|
| EP | 0 892 079 | A1 | 7/1998 |
| EP | 1 143 026 | A1 | 10/2001 |
| EP | 1 867 745 | A1 | 12/2007 |
| EP | 1 873 270 | A1 | 1/2008 |
| JP | 08-134584 | | 5/1996 |
| JP | 09-268343 | | 10/1997 |
| JP | 11-036038 | | 2/1999 |
| JP | 2001-342549 | | 12/2001 |
| JP | 2002-235154 | | 8/2002 |
| JP | 2003-193178 | | 7/2003 |
| JP | 2004-107719 | | 4/2004 |

OTHER PUBLICATIONS

Machine Translation of JP 2004-107719, Published in the Japanese language on Apr. 2004.*

* cited by examiner

*Primary Examiner* — Scott Kastler
*Assistant Examiner* — Vanessa Velasquez
(74) *Attorney, Agent, or Firm* — Clark & Brody

(57) ABSTRACT

According to a low alloy steel of the present invention, compositional elements thereof are limited, and a metal structure thereof comprises bainite or martensite. Further, proper amounts of Nd inclusions are formed by appropriately selecting timings of deoxidation and Nd addition in melting a steel. Consequently, compatibility between high-temperature creep strength and long-term creep ductility, which is hardly established in conventional steels, can be achieved even in hostile conditions. Accordingly, the low alloy steel of the present invention can be widely applied as the material for the heat-resistant structural member used for a long time under the high-temperature and high-pressure conditions such as power plant boilers, turbines, and nuclear power plants.

2 Claims, No Drawings

LOW ALLOY STEEL

This application is a continuation of International Patent Application No. PCT/JP2006/317532, filed Sep. 5, 2006. This PCT application was not in English as published under PCT Article 21(2).

TECHNICAL FIELD

The present invention relates to a low alloy steel having excellent high-temperature creep strength and creep ductility, which is suitable to be used as a heat-resistant structural member such as a boiler tube and turbine for an electric power plant, a nuclear power plant, and a chemical plant facility.

BACKGROUND ART

A boiler tube and turbine for a power plant, a nuclear power plant, and a chemical plant facility are used for a long time in high-temperature and high-pressure environments. Accordingly, superb strength, corrosion resistance, and oxidation resistance at elevated temperatures and high toughness at room temperature are required for these equipments.

Recently, from the viewpoint of prevention of global warming, improvement of thermal efficiency is required to reduce emission of $CO_2$ in thermal power plants, and operation conditions in terms of temperature and pressure become significantly high in the thermal power plant boiler. For example, new plants are being built one after another with operation conditions comprising a temperature of exceeding 600° C. and a pressure of 300 atm. For materials to be used for many hours at high temperatures, it is necessary to ensure creep characteristics. However, the above operation conditions are extremely hostile for heat-resistant steels.

On the other hand, upon a request of relaxation of regulations from home and abroad, marketing is liberated in electricity business, so that firms other than electric power companies or trading houses can enter the electricity business. As a result of severe price competition, economic efficiency is highly regarded than ever before in the power plant.

Additionally, research and development for maintenance of the facilities at low costs without the risk of safety becomes important in not only the new power plants but also aging facilities. Under these circumstances, there arises a growing demand for a heat-resistant steel in which, despite being achieved at low costs, high-temperature strength is enhanced compared with the conventional steels, and development for a high strength material which can respond to the demand is in progress.

Conventionally, Cr—Mo low alloy steels such as JIS G3462 STBA22 (1Cr-0.5Mo steel), JIS G3462 STBA23 (1.25Cr-0.5Mo steel), and JIS G3462 STBA24 (2.25Cr-1Mo steel) are used in a relatively-low temperature range up to about 550° C. Recently, in order to enhance high-temperature creep strength, a steel in which part of Mo is replaced by W (for example, steel disclosed in Japanese Patent Application Publication No. 8-134584) and a steel in which hardenability is significantly enhanced by addition of Co (for example, steel disclosed in Japanese Patent Application Publication No. 9-268343) are developed.

In such newly developed steels, softening resistance is improved at high temperatures by W or Co, and creep strength is particularly improved at not less than 500° C. compared with conventional general-purpose steels. However, it is obvious that, because of pursuing high strength, deterioration of toughness and a decrease in long-term creep ductility (elongation and reduction of area) become prominent.

In order to prevent the deterioration of toughness and to improve the creep ductility, there is proposed a steel in which V, Nb, and Ti are added to the Cr—Mo steel (for example, a steel disclosed in Japanese Patent Application Publication No. 2004-1077191). However, in the steel disclosed in Japanese Patent Application Publication No. 2004-107719, although the toughness is improved, there is further room for improvement in compatibility between the high-temperature creep strength and the creep ductility.

DISCLOSURE OF THE INVENTION

An object of the invention is to provide a low alloy steel for a heat-resistant structural member to be used in a temperature range up to about 550° C. in the power plant and the like, the low alloy steel having the high-temperature creep strength higher than that of the conventional steels and the excellent long-term creep ductility.

In order to achieve the object, the inventors precisely studied effects of chemical compositions and metal structure (micro structure) of steel on the long-term high-temperature creep strength and creep ductility for various heat-resistant low alloy steels. As a result, the inventors obtain new findings (a) to (c) below.

(a) When C is properly added to the Cr—Mo steel, C forms MX type precipitates or $M_2X$ type precipitates (M denotes metal element and X denotes carbide or carbonitride) combining with Cr, Mo, and the like to cause remarkable precipitation strengthening. In order to enhance the high-temperature creep strength, it is necessary that a metal structure of the Cr—Mo steel comprises bainite or martensite.

(b) In the Cr—Mo steel, sulfide inclusions are formed near grain boundaries even in an appreciably smaller amounts of S, the sulfide inclusions cause uneven recovery and recrystallization near prior gamma grain boundaries to decrease the creep ductility of steel. When the amounts of S are extremely decreased, the creep ductility is improved while the steel making cost is significantly increased.

(c) Even if Nd is simply added to the steel, the creep ductility cannot be improved. However, Nd-containing oxysulfide inclusions (hereinafter referred to as "Nd inclusions") such as $Nd_2O_2SO_4$ and $Nd_2O_2S$ can be formed in the prior gamma grain boundaries by selecting an appropriate timing of deoxidation and Nd addition in melting the steel, and the steel in which the proper amounts of Nd inclusions are formed exhibits an extremely excellent creep ductility.

The low alloy steel according to the invention is based on the above-described findings, and the gist of the invention pertains to low alloy steels shown in (1) and (2) below.

(1) A low alloy steel, characterized in that: the steel comprises, in terms of mass %, C, 0.05 to 0.15%, Si: 0.05 to 0.70%, Mn: 1.50% or less, P: 0.020% or less, S: 0.010% or less, Cr: 0.8 to 8.0%, Mo: 0.01 to 1.00%, Nd: 0.001 to 0.100%, sol. Al: 0.020% or less, N, 0.015% or less and 0 (oxygen): 0.0050% or less, the balance being Fe and impurities; a metal structure thereof comprises bainite or martensite; and Nd inclusions are formed therein in the range of 0.1 μm to 10 μm in terms of size, and the number of inclusions per 1000 $\mu m^2$ ranges from 10 to 1000.

(2) The low alloy steel of (1), characterized in that the steel, instead of part of Fe, may contain one or more elements selected from a group consisted of Cu: 0.5% or less, Ni: 0.5% or less, V: 0.5% or less, Nb: 0.2% or less, W: 2.0% or less, B: 0.01% or less, Ti: 0.020% or less, and Ca: 0.0050% or less.

In the low alloy steel of the present invention, the compatibility between the high-temperature creep strength and the long-term creep ductility, which is hardly established in conventional steels, can be achieved even in hostile conditions. Accordingly, the low alloy steel of the present invention can exhibit the extremely effective characteristics as the material for the heat-resistant structural member to be used for many hours under the high-temperature and high-pressure conditions such as the power plant boiler and turbine, the nuclear power plant, and the like.

BEST MODE FOR CARRYING OUT THE INVENTION

The reason why the chemical compositions of the low alloy steel of the present invention are defined as the above will be described in detail. In the following description, "%" indicates "mass %" unless otherwise noted.

C: 0.05 to 0.15%

C is an element which forms the MX type precipitates or $M_2X$ type precipitates (M denotes metal element and X denotes carbide or carbonitride) combining with Cr, Mo and the like to improve high-temperature strength and creep strength. However, in the case of a C content of less than 0.05%, not only the amounts of MX type precipitates or $M_2X$ type precipitates become insufficient, but also hardenability is lowered and further ferrite likely precipitates. Therefore, the high-temperature strength and creep strength are lowered.

On the other hand, when the C content exceeds 0.15%, the MX type precipitates, $M_2X$ type precipitates, and other carbides such as $M_6C$ carbides, $M_{23}C_6$ carbides, and $M_7C_3$ carbides (M denotes metal element) are excessively precipitated to significantly harden the steel. Therefore, workability and weldability are decreased. Accordingly, the C content is set in the range of 0.05 to 0.15%.

Si: 0.05 to 0.70%

Si is added as a deoxidizing element during the steel making, and Si is an effective element for steam oxidation resistance of the steel. A Si content is set to 0.05% or more in order to sufficiently obtain the deoxidation effect and steam oxidation resistance. Preferably, the Si content is set to 0.10% or more. However, when the Si content exceeds 0.70%, the steel toughness is remarkably lowered to incur reduction of the creep strength. Accordingly, the Si content is set in the range of 0.05 to 0.70%.

Mn: 1.50% or Less

Mn is an effective element which exerts both desulfurizing action and deoxidation action to enhance the steel hot workability. Mn also has an effect of enhancing the steel hardenability. Therefore, a Mn content is preferably set to 0.01% or more. However, when the Mn content exceeds 1.50%, since Mn has an adverse effect on the creep ductility, the Mn content is set to 1.50% or less. More preferably, the Mn content is to range from 0.1% to 1.0%.

P: 0.020% or Less

P is an impurity element contained in the steel. When the steel excessively contains P, the P has an adverse effect on the toughness, workability, and weldability. P also has a property of segregating in the grain boundaries to worsen susceptibility to temper brittleness. Accordingly, the steel preferably contains P as little as possible. However, in consideration of the cost reduction, the upper limit of P is set to 0.020%.

S: 0.010% or Less

Similarly to P, S is an impurity element contained in the steel. When the steel excessively contains S, the S has an adverse effect on the toughness, workability, and weldability. S also has a property of segregating in the grain boundaries to worsen susceptibility to the temper brittleness. Accordingly, the steel preferably contains S as little as possible. However, since excessive reduction of S leads to the cost increase, the upper limit of S is set to 0.010% in consideration of the cost reduction.

Cr: 0.8 to 8.0%

Cr is an element necessary for insuring the oxidation resistance and the high-temperature corrosion resistance. However, these effects can not be obtained when a Cr content is less than 0.8%. On the other hand, when the Cr content exceeds 8.0%, the weldability and thermal conductivity are lowered and material cost is increased to lower the economic efficiency. Therefore, the merit of the ferritic heat-resistant steel is decreased. Accordingly, the Cr content is set in the range of 0.8 to 8.0%. Preferably, the Cr content ranges from 0.8 to 2.5%, more preferably from 0.8 to 1.5%.

Mo: 0.01 to 1.00%

When Mo is added to the steel, Mo contributes to the improvements of the creep strength and high-temperature strength by solid-solution strengthening. Because Mo forms the $M_2X$ type precipitate, Mo has an effect of improving the creep strength and high-temperature strength by the precipitation strengthening. In order to obtain the effects, it is necessary that an Mo content be set to 0.01% or more. However, when the Mo content exceeds 1.00%, the effects of Mo are saturated and the addition of large amounts of Mo leads to the cost increase of material.

Accordingly, the Mo content is to range from 0.01 to 1.00%.

Nd: 0.001 to 0.100%

Nd is an important element which is necessary for improving the creep ductility for the low alloy steel of the present invention. Nd is also an effective element which is used as a deoxidizing agent. Nd has effects of forming micro inclusions in steel and immobilizing a solid-solutioned S. In order to obtain the effects, it is necessary that a Nd content be set to 0.001% or more. Preferably the Nd content is set to more than 0.01%. However, when the Nd content exceeds 0.100%, the effects of Nd are saturated and the addition of the excessive amounts of Nd leads to the lowered toughness. Accordingly, the Nd content is set in the range of 0.001 to 0.100%.

Sol. Al: 0.020% or Less

Al is an important element which is used as a deoxidizing agent. When an Al content exceeds 0.020%, the creep strength and workability are decreased. Therefore a sol. Al content is set to 0.020% or less.

N: 0.015% or Less

N is an impurity element. However, N is a solid-solution strengthening element, and sometimes forms carbonitrides to contribute to the strengthening of the steel. In order to obtain the effects of N, it is necessary that an N content be set to 0.005% or more. However, since the excessive addition of N has an adverse effect on the creep ductility, the upper limit of N content is set to 0.015%.

O (oxygen): 0.0050% or Less

O (oxygen) is an impurity element contained in the steel. When O is excessively contained in the steel, the O has an adverse effect on the toughness and the like. Therefore, the upper limit of O is set to 0.0050%. For the O content, the less the better.

Metal Structure of Steel:

The metal structure of the low alloy steel of the present invention comprises bainite or martensite for the purpose of ensuring the high-temperature creep strength without lowering the long-term creep ductility. In this case, a ferrite ratio in the structure is preferably set to 5% or less.

In the case where the steel structure is formed from a dual-phase structure of bainite and ferrite, or where the steel structure is formed from a dual-phase structure of martensite and ferrite, fine precipitates are formed in bainite or martensite to thereby enhance the high-temperature strength and creep strength, while the precipitates are most likely coarsened in ferrite to thereby cause the lowering of the precipitation strengthening function. Therefore, a difference in deformability (such as high-temperature strength and toughness) is generated between the phases constituting the dual-phase structure, and sometimes the toughness or creep strength is deteriorated. Therefore, the upper limit of the ferrite ratio in the structure is preferably set to 5%.

The bainitic structure or martensitic structure defined by the present invention can be obtained by rapid-cooling or air-cooling the steel, which has been formed in a predetermined product shape, from a temperature range of $Ar_3$ or $Ac_3$ transformation point (from about 860 to about 920° C.). However, because the low alloy steel of the present invention is excessively hard in a rapid-cooled or air-cooled condition, the low alloy steel is used after a tempering treatment at an appropriate temperature for an appropriate time (for example, the temperature and time described in Examples below) according to a chemical composition thereof.

Nd Inclusions in Steel:

The sufficient improvement of the creep ductility is not achieved only by the addition of Nd, but it is necessary that the inclusions containing Nd in steel range from 0.1 μm to 10 μm in terms of size, and that the number of Nd inclusions per 1000 $\mu m^2$ range from 10 to 1000.

When the size of the Nd inclusions is less than 0.1 μm, the inclusions cannot become nuclei for generating recovery recrystallization due to the excessively small inclusions. On the other hand, when the size of the Nd inclusions exceeds 10 μm, the inclusions cannot become nuclei for generating even recovery recrystallization due to the coarse Nd inclusions. Therefore, the Nd inclusions of either size as above do not effectively act on the improvement of the creep ductility. Accordingly the size of the Nd inclusion is to range from 0.1 μm to 10 μm.

When the number of Nd inclusions per 1000 $\mu m^2$ is less than 10, since the number of nuclei is not sufficient to generate the recovery recrystallization, the Nd inclusions do not effectively act on the improvement of the creep ductility. On the other hand, when the number of Nd inclusions per 1000 $\mu m^2$ exceeds 1000, because a ratio of inclusions to matrix phase, the matrix phase being directed to deform, becomes excessively high, the Nd inclusions do not contribute to the improvement of the creep ductility. Accordingly, the number of Nd inclusions per 1000 $\mu m^2$ ranges from 10 to 1000.

In order to control the characteristics of the Nd inclusions within the above-described ranges, for example, it is necessary that the deoxidation of steel be performed, Nd be added, and the deoxidation of steel be further performed.

In the low alloy steel of the present invention, when the requirements of the above chemical composition, metal structure, and Nd inclusions are satisfied, the compatibility can be sufficiently achieved between the high-temperature creep strength and the creep ductility. The low alloy steel of the present invention may contain the following element(s) if needed.

Cu: 0.5% or Less

Cu is an optional element. However, when Cu is added, Cu can contribute to stabilize bainite or martensite in the matrix to enhance the creep strength. Therefore, in the case where the creep strength is further enhanced, Cu may be positively added, and the effect of Cu becomes prominent when a Cu content is 0.01% or more. However, when the Cu content exceeds 0.5%, the creep ductility is lowered. Accordingly, when Cu is added, it is preferable that the Cu content is set to be a range from 0.01 to 0.5%.

Ni: 0.5% or Less

Ni is an optional element. However, when Ni is added, Ni can contribute to stabilize bainite or martensite in the matrix to enhance the creep strength. Therefore, in the case where the creep strength is further enhanced, Ni may be positively added, and the effect of Ni becomes prominent when a Ni content is 0.01% or more. However, the Ni content exceeding 0.5% lowers an austenitic transformation temperature ($A_{c1}$ point) of the steel. Accordingly, when Ni is added, it is preferable that the Ni content is set to be a range from 0.01 to 0.5%.

V: 0.5% or Less

V is an optional element. However, when V is added, V forms the MC type carbides together with Nb described below to contribute to the enhancement of the steel strength. Therefore, in the case where the steel strength is further enhanced, V may be positively added, and the effect of V becomes prominent when a V content is 0.01% or more. However, when the V content exceeds 0.5%, the long-term creep ductility is lowered. Accordingly, when V is added, it is preferable that the V content is set to be a range from 0.01 to 0.5%.

Nb: 0.2% or Less

Nb is an optional element. However, when Nb is added, similarly to V, Nb forms the MC type carbides to contribute to the enhancement of the steel strength. Therefore, in the case where the steel strength is further enhanced, Nb may be positively added, and the effect of Nb becomes prominent when a Nb content is 0.01% or more. However, when the Nb content exceeds 0.2%, the carbonitride is excessively formed to lose the toughness. Accordingly, when Nb is added, it is preferable that the Nb content is set to be a range from 0.01 to 0.2%.

W: 2.0% or Less

W is an optional element. However, when W is added, W has an effect of stabilizing carbides for a long time to enhance the creep strength. Therefore, in the case where the steel strength is highly regarded to demand further enhancement of the high-temperature and long-term creep strength, W may be positively added, and the effect of W becomes prominent when a W content is 0.01% or more. However, when the W content exceeds 2.0%, not only the creep ductility is lowered, but also reheat embrittlement and crack sensitivity are increased. Accordingly, when W is added, it is preferable that the W content is set to be a range from 0.01 to 2.0%.

B: 0.01% or Less

B is an optional element. However, when B is added, B can improve the hardenability. Therefore, in the case where the effect of the improved hardenability is required, B may be positively added, and the effect of B becomes prominent when a B content is 0.002% or more. However, the excessive amounts of B has an adverse effect on the toughness. Accordingly, when B is added, it is preferable that the B content is set to be a range from 0.002 to 0.01%.

Ti: 0.020% or Less

Ti is an optional element. However, when Ti is added, Ti forms fine carbides to contribute to the enhancement of the steel strength. Therefore, in the case where the effect of enhanced steel strength is required, Ti may be positively added, and the effect of Ti becomes prominent when a Ti content is 0.005% or more. On the other hand, when the Ti content exceeds 0.020%, Ti has an adverse effect on the toughness. Accordingly, when Ti is added, it is preferable that the Ti content is set to be a range from 0.005 to 0.020%.

Ca: 0.0050% or Less

Ca is an optional element. However, when Ca is added, Ca contributes to the improvement of the weldability. Therefore, in the case where the effect of the improved weldability is required, Ca may be positively added, and the effect of Ca becomes prominent when a Ca content is 0.0003% or more. However, when the Ca content exceeds 0.0050%, Ca has an adverse effect on the creep strength and ductility. Accordingly, when Ca is added, the upper limit of Ca is set to 0.0050%.

EXAMPLES

Using a vacuum induction melting furnace, twelve (12) kinds of alloys having chemical compositions shown in Table 1 were melted and prepared to obtain ingots of 144 mm in diameter and 50 kg in weight. When the alloys were melted and prepared, the deoxidation and Nd addition methods were varied to control the characteristics of the Nd inclusions.

Inventive Examples (steel Nos. 1 to 5) and Steel Nos. 8, 10, and 11 of Comparative Examples were deoxidized with Al after ferrosilicon and ferromanganese were added, then Nd was added, and Mn—Si was added to perform the deoxidation.

Nd was not added in Steel Nos. 6 and 7 of Comparative Examples.

In Steel No. 9 of Comparative Example, after Nd was added, the ferrosilicon, ferromanganese, and Al were added to perform the deoxidation. In Steel No. 12 of Comparative Example, Nd was added after the ferrosilicon, ferromanganese, and Al were added to perform the deoxidation.

Hot forging and hot rolling were performed to the obtained ingot to form a steel plate having a thickness of 20 mm. Then, the steel plate was soaked at a temperature in the range of 950 to 1050° C. for at least 10 minutes and air-cooled. Then, as a tempering treatment, the steel plate was soaked at a temperature in the range of 720 to 770° C. for at least 30 minutes and air-cooled. Specimens were taken from the steel plate after the heat treatment, and were subjected to the observation of metal structure, the creep rupture test, and measurements of Nd inclusions. Table 2 shows the results.

In the metal structure observation, a cut section of the specimen was mechanically polished to prepare a surface to be observed, and the surface was etched for 30 seconds using an etching solution of nitric acid (5 ml) and ethanol (95 ml). Then, the etched surface of the specimen was observed with an optical microscope to confirm the metal structure, and the ferrite ratio was measured.

In the creep rupture test, the specimen was prepared such that a specimen's lengthwise direction matches a rolling direction, and the rupture test was performed under the conditions of a test temperature of 550° C. and a load stress of 245 MPa. The creep strength was determined by extrapolating the creep strength under the condition of 550° C.×10,000 hours. Using a measured reduction of area of the ruptured specimen, it was judged that the specimen had the good creep ductility when the value of the reduction of area was 50% or more.

For the Nd inclusions, the specimen was observed with a magnification of 10,000 times using a transmission electron microscope, the size and number of the Nd inclusions were measured in an area of 10 μm×10 μm. The observation was performed for ten visual fields, the maximum and minimum sizes of the Nd inclusions were measured in ten visual fields, and the number of Nd inclusions on average was measured for ten visual fields.

TABLE 1

| Classification | Steel No. | Chemical Compositions (unit: mass %, balance being Fe and impurities) | | | | | | | | |
|---|---|---|---|---|---|---|---|---|---|---|
| | | C | Si | Mn | P | S | Cr | Mo | Nd | Al |
| Inventive Examples | 1 | 0.06 | 0.05 | 0.20 | 0.015 | 0.002 | 1.24 | 0.51 | 0.012 | 0.008 |
| | 2 | 0.06 | 0.15 | 0.12 | 0.012 | 0.002 | 1.24 | 0.49 | 0.005 | 0.007 |
| | 3 | 0.06 | 0.18 | 0.25 | 0.012 | 0.006 | 2.25 | 0.28 | 0.018 | 0.006 |
| | 4 | 0.15 | 0.35 | 0.87 | 0.012 | 0.006 | 2.50 | 0.27 | 0.006 | 0.008 |
| | 5 | 0.12 | 0.24 | 0.29 | 0.012 | 0.005 | 0.81 | 0.92 | 0.013 | 0.010 |
| Comparative Examples | 6 | 0.06 | 0.24 | 0.20 | 0.015 | 0.002 | 1.43 | 0.53 | —* | 0.007 |
| | 7 | 0.02* | 0.24 | 0.20 | 0.015 | 0.002 | 1.37 | 0.55 | —* | 0.008 |
| | 8 | 0.03* | 0.34 | 0.11 | 0.010 | 0.006 | 2.32 | 0.27 | 0.017 | 0.009 |
| | 9 | 0.16 | 0.34 | 0.87 | 0.011 | 0.006 | 2.53 | 0.21 | 0.016 | 0.006 |
| | 10 | 0.15 | 0.35 | 0.87 | 0.012 | 0.006 | 2.50 | 0.27 | 0.13* | 0.008 |
| | 11 | 0.12 | 0.28 | 0.65 | 0.011 | 0.004 | 2.78 | 0.45 | 0.0008* | 0.009 |
| | 12 | 0.13 | 0.31 | 0.85 | 0.010 | 0.004 | 2.28 | 0.23 | 0.018 | 0.007 |

| Classification | Steel No. | Chemical Compositions (unit: mass %, balance being Fe and impurities) | | | | | | | | |
|---|---|---|---|---|---|---|---|---|---|---|
| | | Ca | N | Cu | Ni | V | Nb | W | B | Ti |
| Inventive Examples | 1 | 0.0017 | 0.0052 | 0.15 | 0.29 | 0.09 | 0.045 | — | 0.0039 | 0.014 |
| | 2 | — | 0.0040 | — | — | — | — | — | 0.0040 | 0.012 |
| | 3 | 0.0007 | 0.0064 | — | — | 0.14 | 0.055 | 1.45 | 0.0033 | 0.015 |
| | 4 | 0.0007 | — | — | — | — | — | — | — | — |
| | 5 | 0.0025 | 0.0043 | — | — | — | — | — | 0.0040 | 0.010 |
| Comparative Examples | 6 | 0.0017 | 0.0052 | 0.15 | 0.29 | 0.09 | 0.045 | — | 0.0039 | 0.014 |
| | 7 | 0.0017 | 0.0101* | — | — | — | — | — | 0.0028 | 0.003 |
| | 8 | 0.0007 | 0.0081 | — | — | 0.10 | 0.060 | 1.51 | 0.0022 | 0.004 |
| | 9 | 0.0007 | — | — | — | — | — | — | — | — |
| | 10 | 0.0007 | — | — | — | — | — | — | — | — |
| | 11 | 0.0022 | — | — | — | — | — | — | — | — |
| | 12 | 0.0012 | — | — | — | — | — | — | — | — |

Remark) Symbol * indicates that the figure is out of the range defined by the present invention.

TABLE 2

| Classification | Steel No. | Metal Structure Ferrite Ratio | High -Temperature Creep Strength Creep Strength Extrapolated for 550° C. × 10,000 Hours (MPa) | Creep Ductility Reduction of Area (%) | Characteristics of Nd Inclusions: Size of Nd Inclusions (μm) Minimum | Maximum | Number of Nd Inclusions (per 1,000 (μm$^2$) |
|---|---|---|---|---|---|---|---|
| Inventive Examples | 1 | <1% (B) | 181 | 70 | 0.3 | 5 | 59 |
| | 2 | <1% (B) | 172 | 74 | 0.5 | 6 | 64 |
| | 3 | <1% (B) | 198 | 68 | 0.2 | 3 | 78 |
| | 4 | <1% (B) | 166 | 67 | 0.2 | 2 | 12 |
| | 5 | <1% (B) | 155 | 82 | 0.4 | 4 | 41 |
| Comparative Examples | 6 | <1% (B) | 177 | 11 | — * | — | 0 * |
| | 7 | 90% (F + P) | 66 | 81 | — * | — | 0 * |
| | 8 | 89% (F + P) | 81 | 83 | 0.2 | 3 | 38 |
| | 9 | <1% (B) | 166 | 23 | — * | — | 0 * |
| | 10 | <1% (B) | 76 | 18 | 0.6 | 19 * | 106 |
| | 11 | <1% (B) | 167 | 33 | 0.02 * | 0.09 | 89 |
| | 12 | <1% (B) | 151 | 24 | 0.3 | 9 | 1230 * |

Remarks) Symbol * indicates that the composition is out of the range defined by the present invention. For reference letters used in metal structures of Table 2, B, F and P designate bainite, ferrite, and pearlite, respectively.

As is clear from Table 2, in Steel Nos. 1 to 5 of Inventive Examples, the metal structure exhibits bainite whose ferrite ratio was not more than 5%. The sizes of the Nd inclusions range from 0.1 to 10 μm, and the number of Nd inclusions per 1000 μm$^2$ was controlled within the range of 10 to 1000. Therefore, in Steel Nos. 1 to 5 of Inventive Examples, the high-temperature creep strength exceeded 150 MPa and the reduction of area was not less than 67%, indicating good creep ductility.

On the contrary, in Comparative Examples which were out of the ranges defined by the present invention, either the creep strength or creep ductility, or otherwise, both were defective, and the compatibility was not able to be achieved therebetween. In Steel No. 6, because Nd, which was one of the most important elements for the low alloy steel of the present invention to improve the creep ductility, was not contained, the creep ductility (reduction of area) was low and the Nd inclusions were not generated.

In Steel No. 7, Nd was not contained, C and N were out of the ranges defined by the present invention, and the metal structure comprised ferrite+pearlite. The creep strength extrapolated for 550° C.×10,000 hours was as low as 66 MPa. However, because of the low-strength material, Steel No. 7 exhibited a high value in the creep ductility.

In Steel No. 8, C was out of the range defined by the present invention, and the metal structure comprised ferrite+pearlite. Therefore, Steel No. 8 exhibited a low value in the creep strength extrapolated for 550° C.×10,000 hours.

In Steel No. 9, although the chemical and metal compositions satisfied the ranges defined by the present invention, the timing of Nd addition was improper. Therefore, since no Nd inclusions was generated in the steel, although the creep strength was acceptable, the creep ductility was defective.

In Steel No. 10, the Nd content exceeded the range defined by the present invention. Therefore, although the Nd inclusions were generated, the maximum size of the Nd inclusions was coarsened to 19 μm, and the creep strength and creep ductility are defective.

In Steel No. 11, the Nd content was less than the range defined by the present invention. Although the Nd inclusions were generated, the minimum size of the Nd inclusions was as small as 0.02 μm. Therefore, the Nd inclusions did not effectively act on the recovery recrystallization, and the creep ductility was defective.

In Steel No. 12, although the chemical and metal compositions satisfied the ranges defined by the present invention, the Nd inclusions were excessively generated in the steel because the timing of Nd addition was improper. Therefore, although the creep strength was acceptable, the creep ductility was defective.

INDUSTRIAL APPLICABILITY

According to the low alloy steel of the present invention, component compositions thereof are limited, and the metal structure thereof comprises bainite or martensite. Further, the proper amounts of Nd inclusions are formed by appropriately selecting the timings of deoxidation and Nd addition in melting the steel. Consequently, the compatibility between the high-temperature creep strength and the long-term creep ductility, which is hardly established in conventional steels, can be achieved even in hostile conditions. Accordingly, the low alloy steel of the present invention can widely be applied as the material for the heat-resistant structural member to be used for a long time under the high-temperature and high-pressure conditions such as the power plant boiler and turbine, the nuclear power plant, and the like.

The invention claimed is:

1. A low alloy steel, consisting of, in terms of mass %, C: 0.05 to 0.15%, Si: 0.15 to 0.70%, Mn: 1.50% or less, P: 0.020% or less, S: 0.010% or less, Cr: 0.8 to 2.5%, Mo: 0.01 to 1.00%, Nd: 0.001 to 0.100%, sol. Al: 0.020% or less, N: 0.015% or less and O (oxygen): 0.0050% or less, the balance being Fe and impurities, wherein a metal structure thereof consists essentially of bainite and a ferrite ratio of 5% or less, and wherein inclusions containing Nd are formed therein in the range of from 0.1 μm to 10 μm in terms of size; and wherein the number of inclusions per 1000 μm$^2$ ranges from 10 to 1000.

2. A low alloy steel, consisting of, in terms of mass %, C: 0.05 to 0.15%, Si: 0.15 to 0.70%, Mn: 1.50% or less, P:

0.020% or less, S: 0.010% or less, Cr: 0.8 to 2.5%, Mo: 0.01 to 1.00%, Nd: 0.001 to 0.100%, sol. Al: 0.020% or less, N: 0.015% or less and O (oxygen): 0.0050% or less, and one or more elements selected from a group consisting of Cu: 0.5% or less, Ni: 0.5% or less, V: 0.5% or less, Nb: 0.2% or less, W: 2.0% or less, B: 0.01% or less, Ti: 0.020% or less, and Ca: 0.0050% or less, the balance being Fe and impurities, wherein a metal structure thereof consists essentially of bainite and a ferrite ratio of 5% or less, and wherein inclusions containing Nd are formed therein in the range of from 0.1 μm to 10 μm in terms of size; and wherein the number of inclusions per 1000 $\mu m^2$ ranges from 10 to 1000.

* * * * *